US006053264A

United States Patent [19]

Frankel et al.

[11] Patent Number: 6,053,264

[45] Date of Patent: Apr. 25, 2000

[54] CUTTER HEAD MOUNTING FOR DRILL BIT

[75] Inventors: Kenneth A. Frankel, Issaquah, Wash.; Thomas E. Carson, Boulder, Colo.

[73] Assignee: Sunrise Enterprises, LLC, Kent, Wash.

[21] Appl. No.: 08/856,736

[22] Filed: May 15, 1997

[51] Int. Cl.[7] ..... E21B 10/22

[52] U.S. Cl. ..... 175/371; 175/367

[58] Field of Search ..... 175/370, 371, 175/372, 367; 384/503, 92, 93, 95, 96

[56] References Cited

U.S. PATENT DOCUMENTS

| | | | |
|---|---|---|---|
| 959,540 | 5/1910 | Hughes . | |
| 2,058,624 | 10/1936 | Reed . | |
| 3,917,361 | 11/1975 | Murdoch | 308/8.2 |
| 3,971,600 | 7/1976 | Murdoch et al. | 308/8.2 |
| 3,990,751 | 11/1976 | Murdoch | 308/8.2 |
| 4,074,922 | 2/1978 | Murdoch | 308/8.2 |
| 4,075,886 | 2/1978 | Barker | 73/88 R |
| 4,157,122 | 6/1979 | Morris | 175/369 |
| 4,254,838 | 3/1981 | Barnetche | 175/228 |
| 4,260,203 | 4/1981 | Garner | 308/8.2 |
| 4,293,171 | 10/1981 | Kakumoto et al. | 308/188 |
| 4,444,518 | 4/1984 | Schramm et al. | 384/96 |
| 4,446,933 | 5/1984 | Bodine | 175/229 |
| 4,478,299 | 10/1984 | Dorosz | 175/369 |
| 4,506,997 | 3/1985 | Schramm et al. | 384/96 |
| 4,572,306 | 2/1986 | Dorosz | 175/371 |
| 4,738,323 | 4/1988 | Mathews | 175/371 |
| 4,834,193 | 5/1989 | Leitko, Jr. et al. | 175/19 |
| 4,911,255 | 3/1990 | Pearce | 174/368 |
| 4,934,467 | 6/1990 | Langford, Jr. | 175/371 |
| 4,969,378 | 11/1990 | Lu et al. | 76/108.2 |
| 5,012,701 | 5/1991 | Daly | 76/108.2 |
| 5,024,539 | 6/1991 | Vezirian | 384/92 |
| 5,092,412 | 3/1992 | Walk | 175/372 |
| 5,161,898 | 11/1992 | Drake | 384/95 |
| 5,183,123 | 2/1993 | White | 175/228 |
| 5,358,061 | 10/1994 | Van Nguyen | 175/371 |
| 5,441,120 | 8/1995 | Dysart | 175/228 |
| 5,452,771 | 9/1995 | Blackman et al. | 175/353 |
| 5,513,715 | 5/1996 | Dysart | 175/371 |
| 5,586,611 | 12/1996 | Dorosz | 175/369 |

*Primary Examiner*—David Bagnell
*Assistant Examiner*—Zakiya Walker
*Attorney, Agent, or Firm*—James R. Young; Chrisman, Bynum & Johnson

[57] ABSTRACT

A mounting for cutter wheels on rotary rock drill bits includes a spindle with two annular axial load bearing surfaces, one of which interfaces in a rotational relationship with a cylindrical segmented bushing affixed to the inside surface of a cavity in the cutter wheel and the other of which interfaces through a top hat bushing flange in a rotational relationship with an annular end bearing surface in the cavity of the cutting wheel. A compressive silver coating on the cylindrical bushing before it is split, leaving uncoated edges for precise registration and bit onto a cylindrical race surface machined into the spindle, provides lubrication in addition to compressing under load to distribute axial loading forces from the cutter wheel in proportion to the two axial load bearing surfaces on the spindle. A small, precise, initial clearance between the annular end bearing surface in the cavity of the cutter wheel and the distal axial load bearing surface on the spindle, which clearance disappears upon initial wear-in and seating, also provides proportional axial load distribution to the two axial load bearing surfaces on the spindle. A slanted seal groove in the cutter wheel allows positioning the cylindrical bushing close to the proximal end surface while protecting the seal from a worn proximal end surface.

21 Claims, 5 Drawing Sheets

CUTTER HEAD MOUNTING FOR DRILL BIT

BACKGROUND OF THE INVENTION

1. Field of the Invention

The present invention is related generally to rotary mining and oil well drilling bits and more specifically to an improved bushing mounting structure for mounting and lubricating a rotatable cutter head on a mining or oil well drilling bit.

2. State of the Prior Art

"Rock bits" that are used in the mining industry to drill holes into rock formations and in the oil and gas industry to drill oil and gas wells into oil or gas bearing rock formations deep in the ground typically comprise a plurality (usually three) conical-shaped rotary cutter wheels that are rotatably mounted in a cluster on the distal end of a drive shaft or string of drill pipe. Each of such rotary cutter wheels usually has a plurality of hard radially protruding teeth that are designed to mesh loosely with teeth on adjacent cutter wheels and are oriented in such a way that, as the cluster is rotated about a major rotation axis by a drive shaft or drill pipe string, the teeth on the cutter wheels engage the rock formation into which a hole is being drilled and cut, break, or crush chunks or pieces of the rock formation so that such chunks or pieces can be carried out of the hole by a circulating drilling fluid.

The axial and angular forces that have to be applied to rock bits in order to achieve the rock cutting, breaking, and crushing action that is necessary to drill holes in rock formations are tremendous. The rock cuttings are hard and abrasive, and the resulting wear and tear on the rotary cutter wheels, especially in the journal mounting structures that rotatably mount the cutter wheels to the main body or trunk of the rock bits, are severe. There have been many improvements in all components of rock bits over the years, including, but certainly not limited to, rotary cutter mountings, lubricating systems, materials, teeth structures, drilling fluid nozzles, and the like. The numbers and varieties of such improvements and innovations are far too numerous to chronicle here. Yet, because of the large forces and severe conditions into which the rock bits operate, rapid wear and resulting breakage of cutter wheels and mounting component continues to be a constant and persistent problem.

The U.S. Pat. No. 4,572,306, issued to D. Dorosz, which is incorporated herein by reference, discloses a segmented bushing that is shrink-fit and further retained by a lock ring in the cutter wheel and rotatably mounts the cutter wheel in journal fashion on a spindle. It also discloses a second bushing and thrust surface around a protruding distal end of the spindle, a lubrication system for routing grease to the bushings, and an O-ring elastomeric seal at the proximal end of the spindle to keep abrasive rock debris away from the bushings. This rock bit structure has performed quite well as compared to other state-of-the-art rock bits for many years. However, failures of the seals and shortly thereafter bushing failures still occur too frequently. When the rock bit is on the end of a string of oil well drilling pipe that may extend one to two miles or more into the ground, it takes many hours to "trip" out of the well hole to get the rock bit to the surface where it can be changed and then many more hours to trip back into the well hole to resume drilling operations. If the cutter wheel mounting has failed badly enough to allow the cutter wheel to separate from the spindle, that rotary cutter wheel may be left in the bottom of the well hole when the rest of the rock bit is pulled to the surface. In such instances, other time-consuming and costly procedures must be undertaken to fish the lost cutter wheel out of the well hole, because it is made of very hard metal alloys and would inhibit a new rock bit from boring farther into the rock formation. The problem is compounded if the cutter wheel is lost in a horizontal well hole, because conventional fishing techniques and tools that are used in vertical well holes do not work as well, and some not at all, in horizontal well holes.

SUMMARY OF THE INVENTION

Accordingly, it is a general object of this invention to provide improvements in bushing-type journal mountings of rotary cutter wheels on spindles of rock bits to make them more rugged and more durable.

A more specific object of this invention is to provide an improved spindle and bushing structure for rotary cutter wheels of rock bits to enhance their ability to withstand prolonged rock drilling.

Another specific object of this invention is to provide an improved seal between the rotary cutter wheel and the leg of the rock bit on which the cutter wheel is mounted.

A further object of the present invention is to provide an improved lubrication system for feeding grease to the journal mounting of a cutter wheel on a rock bit continuously over an extended time while the rock bit is being operated in a well hole or other rock bore.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a spindle and cutter wheel in which axial forces bear simultaneously on two distinct complementary surfaces that are spaced axially from each other. A split bushing with a compressible silver coating ensures simultaneous loading of the axial bearing race surfaces while also providing natural lubricant to the race surfaces. A slanted seal retainer groove accommodates a larger bushing positioned closer to the bit leg and a larger seal while allowing more and longer wear on the cutter wheel. An interchangeable differential sleeve and piston lubrication system is provided to adopt grease delivery forces to different well depth and drilling fluid weight conditions.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings.

DETAILED DESCRIPTION OF THE PREFERRED EMBODIMENTS

Figure 1:
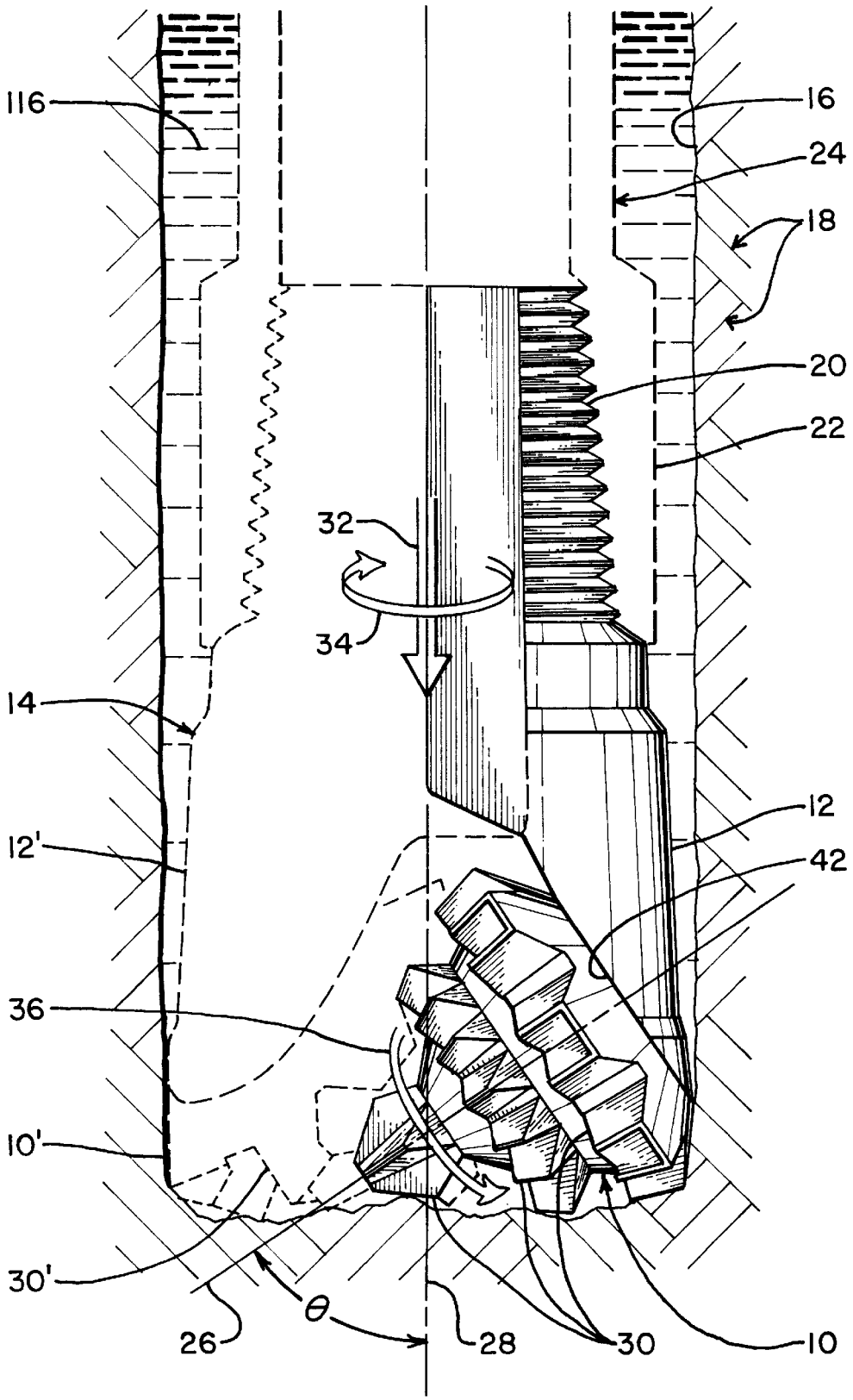
FIG. 1 is a side elevation view of a rock bit with a cutter wheel mounted according to this invention and shown diagrammatically at the bottom of a well hole with duplicate leg portions and cutter wheels indicated by phantom lines in order to provide an orientation of how the invention is used in drilling operations.

For purposes of orientation, a conical cutter wheel 10, one of three such cutter wheels, is shown in FIG. 1 rotatably mounted according to this invention on one of three legs 12 of a rock drilling bit 14 as it is used to drill a well hole 16 or other hole in a hard rock formation 18. The actual structure and details of the rotatable mounting of the cutter wheel 10 on leg 12 according to this invention cannot be seen in FIG. 1, because the rotatable mounting is inside and hidden by the cutter wheel 10. However, the rotatable mounting will be described in detail below.

Essentially, the rock bit 14 comprises of three legs, the leg 12, being one of them, another one of which is indicated by the phantom lines 12', and the third one of which is hidden from the view in FIG. 1 behind legs 12, 12'. The three legs are typically welded together to form the body or trunk of the rock bit 14 and then threaded at the top to form a nipple 20, which can be screwed into a threaded coupling 22 on the end of a drill pipe 24 (shown in phantom lines). A second cutter wheel 10' is shown in phantom lines mounted on the second leg 12', while the third cutter wheel (not shown) is hidden in FIG. 1 behind the cutter wheels 10, 10'. Again, the rock bit 14, other than the one leg 12 and cutter wheel 10 assembly, as well as the drill pipe 24 and coupling 22, is shown in phantom lines to illustrate environment and orientation. The one leg 12 and cutter wheel 10 assembly that are selected for this description of the invention are shown in solid lines in FIG. 1 and are representative of the other cutter wheels and legs.

The cutter wheel 10 is mounted on the leg 12 in a manner that allows rotation of the cutter wheel 10 about a cutter wheel longitudinal axis 26, which is oriented at an acute angle $\Theta$ to the longitudinal axis 28 of the well hole 16, drill pipe 24, and rock bit 14. The angle $\Theta$ is typically matched with the conical shape of the cutter wheel 10 so that the teeth 30 on the periphery of the cutter wheel 10 engage the rock formation being drilled along a line that is generally perpendicular to the longitudinal axis 28 of the rock bit 14 and well hole 24. When a vertical force and an angular or rotational force are applied by the drill pipe 16 to the rock bit 14, as indicated by arrows 32, 34, respectively, the teeth 30 of the cutter wheel 10 engage the rock formation 18 at the bottom of the well hole 16 and not only cut or break out chunks and pieces of rock at the bottom of the well hole 16, but also impart angular or rotational forces to the cutter wheel 10 to cause the cutter wheel 10 to rotate about its longitudinal axis 26, as indicated by arrow 36. The teeth 30 of the cutter wheel 10 are also typically designed and constructed to mesh loosely with the teeth 30' on the other two cutter wheels 10' to help keep all the cutter wheels 10', 10' rotating as well as to further crush and grind rock pieces and chunks that are broken loose from the rock formation 18 into smaller particles that can be carried out of the well hole 16 by drilling fluid 116. During drilling operations, the vertical force 32 that is applied by the drill pipe 24 to the rock bit 14 is very large, and the pieces and chunks of rock formation that are broken loose and ground by the cutter wheels 10 at the bottom of the well hole 16 cause large sustained forces as well as severe instantaneous shock spikes and stresses on the structure that rotationally mounts the cutter wheel 10 onto the leg 12.

Figure 2:
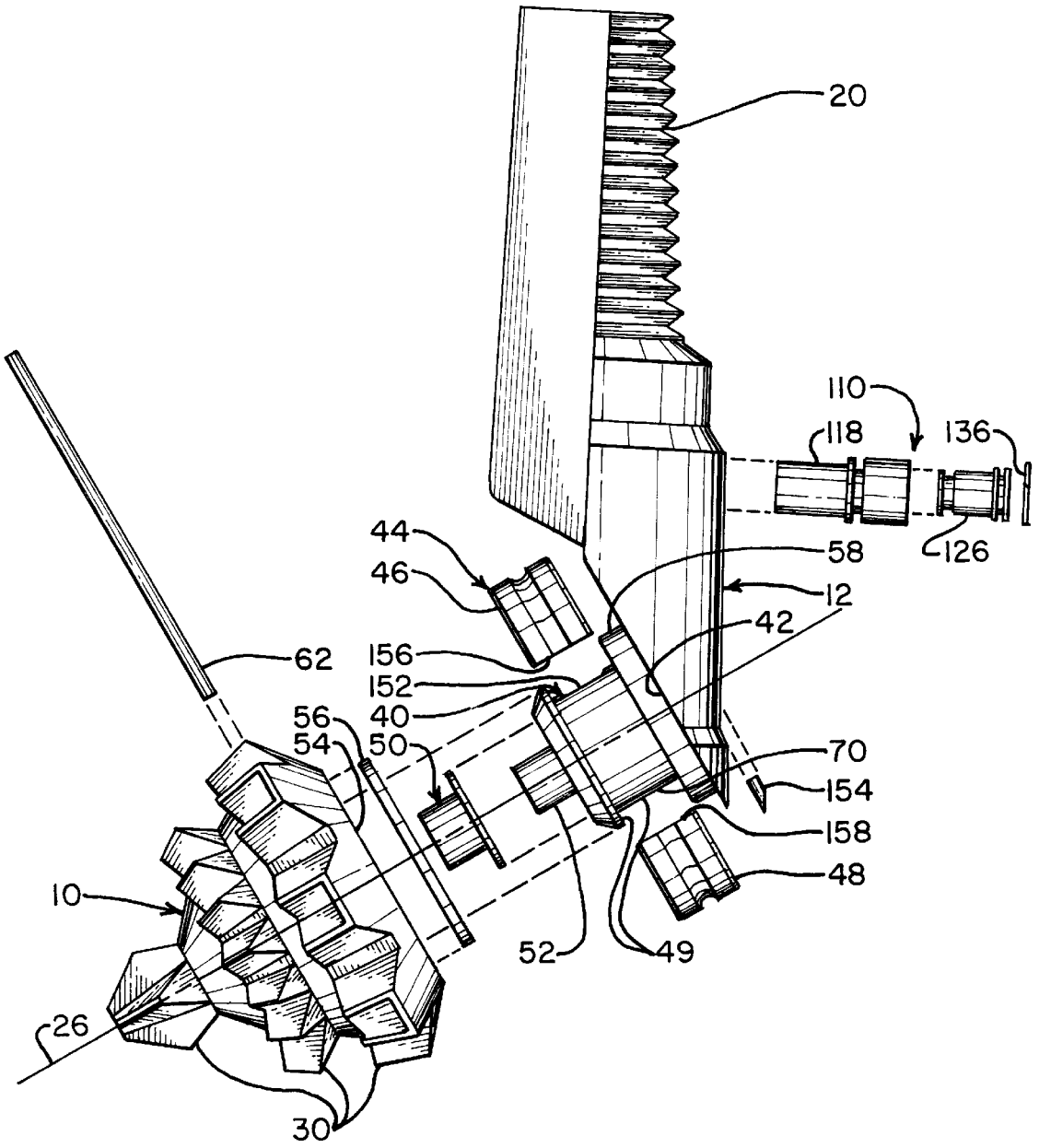
FIG. 2 is an exploded side elevation view illustrating the components of the improved bushing mounting of the cutter wheel on a rock bit and the lubricating system according to the present invention.
Figure 3:
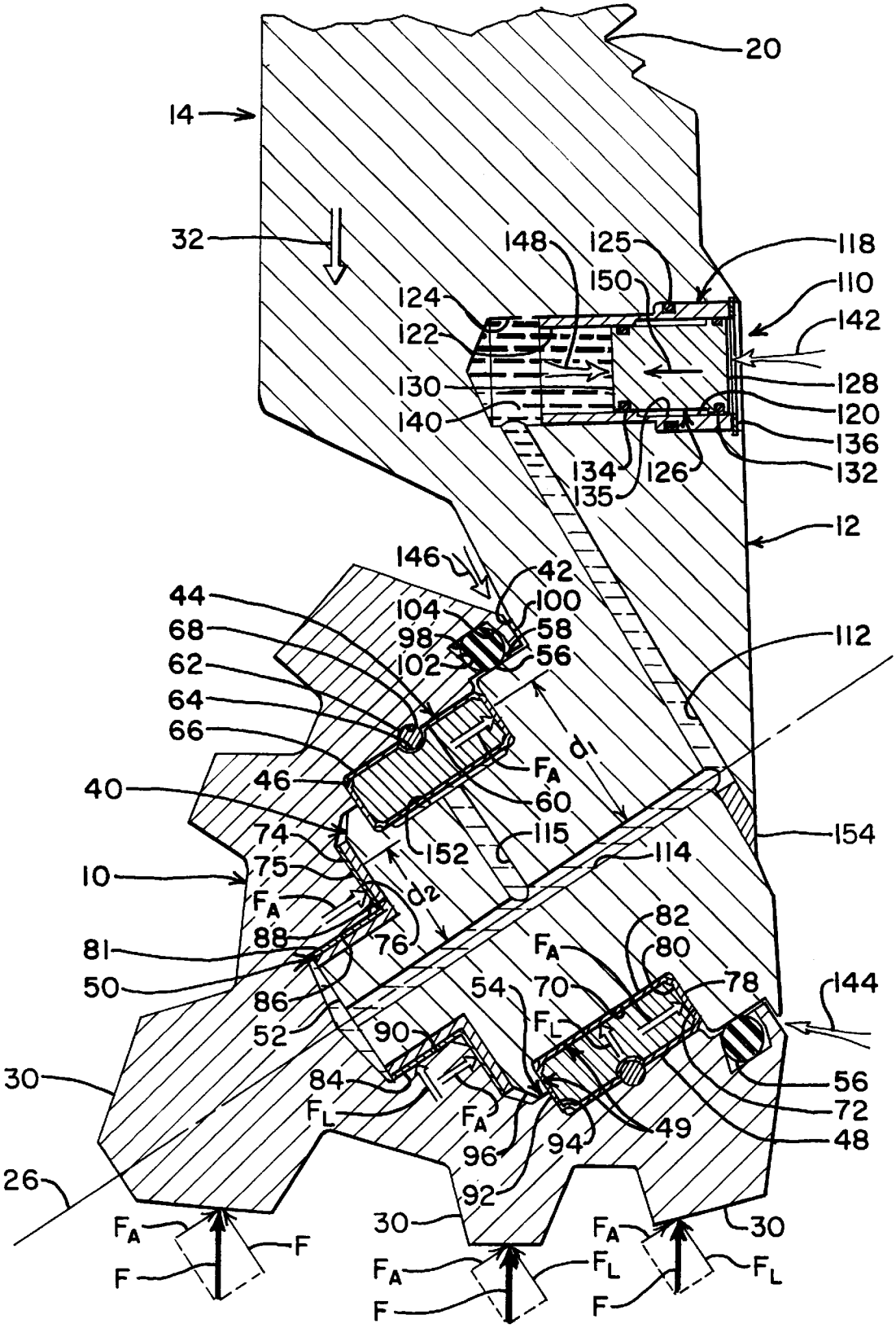
FIG. 3 is an enlarged view in cross-section of the cutter wheel mounted rotatably on a spindle of a rock bit as well as the lubricating system in a leg of the rock bit according to the present invention.

The details of the mounting structure of the present invention for mounting the cutter wheel 10 rotatably on the leg 12 are best seen in FIGS. 2 and 3. A stub axle or spindle 40 protrudes from an inside face 42 of the leg 12 inwardly toward the longitudinal axis 28 of the bit 14 (FIG. 1) and downwardly to define the longitudinal axis 26 about which the cutter wheel 10 rotates as described above. A cylindrical bushing 44 comprising two half-bushing segments 46, 48 fit into a large diameter, cylindrical race channel 49 around the midsection of the spindle 40, and a top hat bushing 50 fits over a smaller diameter stub shaft 52 that protrudes axially from the midsection to the distal end of the spindle 40. The top hat bushing 50 is optional but recommended for more durable bearing surfaces and to help effect beneficial distribution of loading forces between primary and secondary thrust bearing surfaces, as will be described in more detail below. With the cylindrical bushing 44 and the top hat bushing 50 assembled onto the spindle 40 as described above, the spindle 40 is inserted into a cavity 54 that is machined axially into the cutter wheel 10 with internal shapes and sizes corresponding to the external shapes and sizes of the spindle 40 assembled with the segmented bushings 44, and the top hat bushing 50, some of which will be described in more detail below. A seal, preferably an O-ring seal 56 made of a durable, resilient elastomeric material, such as silicone rubber or other such material as is well-known in the machine parts sealing art, is also assembled into the cavity 54 of the cutter wheel 10 to fit in a sealing relationship over the enlarged shoulder 58 at the proximal end of the spindle adjacent the inner face 42 of the leg 12 to prevent debris from getting into and damaging the cylindrical bushing 44 and interfacing bearing surfaces, as will also be described in more detail below. It is preferred that the portion of the cavity 54 of the cutter wheel 10 is machined slightly undersized in diameter as compared to the cylindrical bushing 44 and that the cutter wheel 10 then be heated to expand the cavity 54 in cutter wheel 10 before insertion of the assembly comprising spindle 40, cylindrical bushing 44, and top hat bushing 50 into the cavity 54. Then as described in U.S. Pat. No. 4,572,306, which is incorporated herein by reference, when the cutter wheel 10 cools, it shrinks onto the cylindrical bushing 44 and seizes the cylindrical bushing 44 in immoveable relation to the inside surface 60 of cutter wheel 10. After the spindle 40, cylindrical bushing 44, and top hat bushing 50 are inserted into the cutter wheel 10, an elongated retainer pin 62 is driven into an insertion hole (not shown in FIGS. 2 and 3, but described in detail in U.S. Pat. No. 4,572,306) in cutter wheel 10 that aligns tangentially with a keyway formed by a retainer groove 64 in the peripheral surface 66 of cylindrical bushing 44 and a mating retainer groove 68 in the inside surface 60 of cutter wheel 10.

As discussed above, the main loading on the drill bit 14 is a vertical downward force 32 applied by the drill pipe 24 as illustrated in FIG. 1. That vertical downward force 32 is transmitted through the legs 12 to force the cutter wheels 10 into the rock formation 18 at the bottom of the well hole 16.

There is then, according to Newton's third law, an equal and opposite reaction force exerted by the rock formation on the cutter wheels 10. Such reaction force is distributed over many surfaces of the cutter wheels 10, including, but not limited to, the teeth 30 that are in contact with the rock formation 18. These reaction forces F, as illustrated in FIG. 3, are applied on the cutter wheel 10 in a vertically upward direction in opposition to the vertically downward direction of the main loading force 32, but they resolve into axial force vectors or components $F_A$ directed parallel to the longitudinal axis 26 of the spindle 40 and lateral force vectors or components $F_L$ directed perpendicular to the longitudinal axis 26. The cutter wheel 10 transfers these axial force components $F_A$ and lateral force components $F_L$ to the spindle 40, where they are applied to bearing surfaces 72, 74 on the spindle 40 as illustrated in FIG. 3 and as will be explained in more detail below.

As best seen in FIG. 3, the race channel 49 around the midsection of spindle 40 has a cylindrical bearing surface 70 on which the cylindrical bushing 44 spins and an annular inside bearing surface 72 formed by the shoulder 58. Therefore, a substantial portion of the lateral force components $F_L$ exerted by the cutter wheel 10 on the spindle 40 in response to the loading forces 32, 34 (FIG. 1) are borne by the cylindrical bearing surface 70 of race channel 49, and a substantial portion of the axial force components $F_A$ exerted by the cutter wheel 10 on the spindle 40 are borne on the inside bearing surface 72 of race channel 49. However, another thrust bearing surface on the spindle 40 is also provided by the annular bearing surface 74 of the top hat bushing 50 against which an annular end bearing surface 76 in the cavity 54 of the cutter wheel 10 exerts axial forces $F_A$. It is preferred that both the thrust bearing surfaces on the spindle 40 provided by inside bearing surface 72 of race channel 49 and by annular bearing surface 74 of the top hat bushing 50 are loaded when the cutter wheel 10 is operated under the force conditions 32, 34. A combination of close-tolerance machining of the cavity 54 in cutter wheel 10 and the silver coating 80 on surfaces of the cylindrical bushing 44 enhances simultaneous loading of those thrust bearing surfaces on the spindle 40 provided by inside bearing surface 72 of race channel 49 and by annular bearing surface 74 of top hat bushing 50, as will be described in more detail below.

To accomplish such simultaneous loading of the thrust bearing surfaces on the spindle 40 provided by inside bearing surface 72 of race channel 49 and by annular bearing surface 74 of the top hat bushing 50, it is preferred, although not essential, that the cavity 54 in the cutter wheel 10 be machined such that, upon initial assembly, the annular end bearing surface 76 in the cavity 54 remains separated from the annular bearing surface 74 of the top hat bushing 50 by a distance of about 0.001 to 0.002 inch when the inside end surface 78 of cylindrical bushing 44 contacts the annular inside bearing surface 72 of race channel 49 in the spindle 40. Then, when use of the rock bit 14 starts under the load of vertical force 32, the initial wearing-in and seating of the silver coating 80 of inside end surface 78 of cylindrical bushing 44 on the annular inside bearing surface 72 of race channel 49 in spindle 40 occurs before there is significant interfacing contact between the annular end bearing surface 76 in cavity 54 of the cutter wheel 10 and the annular bearing surface 74 of the top hat bushing 50. It is believed that this method of simultaneous loading of thrust bearing surfaces described above ensures that the annular inside bearing surface 72 of the race channel 49 bears a substantial portion of the axial thrust load $F_A$ on spindle 40. There are several reasons supporting this belief, not the least of which is that the annular inside bearing surface 72 is at a greater effective distance $d_1$ from the axis 26 than the effective distance $d_2$ of the annular bearing surface 74 of the top hat bushing 50 from the axis 26. Thus, the annular inside bearing surface 72 of the race channel 49 has more leverage to resist eccentric axial force couples, which tend to cock the cutter wheel 10 on the spindle 40. The annular inside bearing surface 72 of the race channel 49 also has a larger thrust surface area than the annular bearing surface 74 of the top hat bushing 50 over which axial forces $F_A$ are distributed, which minimizes axial thrust pressure on the spindle 40. The annular bearing surface 74 of the top hat bushing 50, however, complements the annular inside bearing surface 72 of the race channel 49 in spindle 40 by providing additional contact surface area over which axial force components $F_A$ are distributed to reduce pressure on spindle 40 surfaces even further. This distribution of axial force in the annular inside bearing surface 72 of the race channel 49 with complementary distribution of axial forces on the annular bearing surface 74 of top hat bushing 50 is enhanced by the silver coating 80 on the cylindrical bushing 44, which not only provides a natural lubricant for relative movement between the cylindrical bushing 44 and the harder metal of the annular inside bearing surface 72 of race channel 49, but which also is slightly more compressible under axial load $F_A$ than the cylindrical bushing 44. Therefore, axial loading causes compression of the silver coating layer 80, which allows the cutter wheel 10 to also press its annular end bearing surface 76 in cavity 54 against the annular bearing surface 74 of the top hat bushing 50 to help bear the heavier axial loading. The top hat bushing 50 is made of a copper-based alloy, which is also softer than the hard metal cutter wheel 10. Therefore, the annular flange 75 of top hat bushing 50 also compresses under pressure from the annular end bearing surface 76 in cavity 54 of cutter wheel 10, although a silver coating 81 can also be provided on top hat bushing 50 to enhance compressibility as well as to lubricate the interface of the annular bearing surface 74 of top hat bushing 50 with annular end bearing surface 76 in cavity 54.

While the structure and manufacturing method described above is currently believed to provide the most effective axial force distribution, it is certainly feasible, as an alternative, to machine the cavity 54 in a manner that is calculated to cause initial contact between the annular bearing surface 74 of top hat bushing 50 and the annular end bearing surface 76 in cavity 54 before the annular inside bearing surface 72 of race channel 49 and the inside end surface 78 of cylindrical bushing 44 contact each other. For example, the cavity 54 of cutter wheel 10 could be machined to cause initial contact between the annular bearing surface 74 of top hat bushing 50 and the annular end bearing surface 76 in cavity 54 when the annular inside bearing surface 72 of race channel 49 and the inside end surface 78 of cylindrical bushing 44 are still separated by about 0.001 to 0.002 inch, instead of the other way described above. Either way, the initial wearing-in or seating, in combination with the silver coating 80 (and optionally silver coating 81) provides a durable, long-lasting axial thrust bearing arrangement between the cutter wheel 10 and the spindle 40.

The lateral force components $F_L$, as mentioned above, are borne by the spindle 40 primarily on the cylindrical bearing surface 70 of race channel 49, where the inside cylindrical surface 82 of cylindrical bushing 44 interfaces with, and spins in relation to, the spindle 40. The silver coating layer 80 on the cylindrical bushing 44 provides a natural lubricant on the harder metal surface of the spindle 10, and a grease lubrication system is also provided, as will be described in more detail below. However, the cylindrical surface 84 of the top hat bushing 50, which is inserted into a smaller diameter extension bore 86 of the cavity 54 in cutter wheel 10, also bears a significant share of the lateral force components $F_L$, exerted by the cutter wheel 10 onto the spindle 40. The top hat bushing 50, if it is provided, is preferably fit over the stub shaft 52. Otherwise, the stub shaft 52 and extension bore 86 are machined to about the same diameter with sufficient tolerance to allow the inside surface 90 of extention bore 86 in cutter wheel 10 to spin in relation to the stub shaft 52 of spindle 40. With the top hat bushing 50, however, the top hat bushing 50 can remain stationary on the stub shaft 52 of spindle 40 so that the inside surface 90 of extention bore 86 in cutter wheel 10 spins in relation to the interfacing cylindrical surface 84 of top hat bushing 50, or it can be free floating on stub shaft 52, which reduces effective velocity of the top surfaces 74, 84 of top hat bushing 50 in relation to the surfaces 76, 90 in cavity 54 of cutter wheel 10.

The angular or rotational force 34 (FIG. 1) applied by the drill pipe onto drill bit 14 does result in some sustained forces on the spindle 40 as the cutter wheel 10 rolls over the rock formation, especially if the spindle 40 is skewed to cause the cutter wheel 10 to gouge as it rotates. Also, if the cutter wheel 10 encounters resistance to its rolling, such as by chunks of rock caught between teeth 30 of cutter wheel 10 and the teeth 30' of adjacent cutter wheels 10' or by chunks of rock caught between cutter wheel 10 and the formation 18, such forces may include significant instantaneous shock or spike loading that resolve into additional lateral force components exerted by the cutter wheel 10 onto spindle 40 in an orientation perpendicular to the axis 26 and perpendicular to the lateral force components $F_A$ shown in FIG. 3, i.e., directed perpendicularly out of the paper in FIG. 3. Such additional lateral force components are still borne by the cylindrical bearing surface 70 of race channel 49 in spindle 40 and by the cylindrical surface 84 of top hat bushing 50, although they may be concentrated on different portions of those cylindrical surfaces 70, 84.

There are no substantial sustained net axial forces in the opposite direction, i.e., which would tend to pull the cutter wheel 10 axially away from leg 12 and off the spindle 40, although chunks of rock caught between the cutter wheel 10 and leg 12 or between teeth 30' of adjacent cutter wheels 10' could result in instantaneous force spikes in that direction. The cylindrical bushing 44, which is seized in cavity 54 by shrink fitting, as described above, or by pressing, adhering, keying, or other means familiar to persons skilled in the art, has an outside lateral surface 92 that bears against an outside race surface 94 formed by a radially enlarged flange 96 on the spindle 40 to keep the cutter wheel 10 from sliding off the spindle 40. Therefore, in order for the mounting structure of this invention to fail sufficiently for the cutter wheel 10 to come off the spindle 40, either (i) cylindrical bushing 44 would have to come out of the cavity 54, (ii) the flange 96 would have to wear off or disintegrate, or (iii) there would have to be enough wear or other disintegration of cylindrical bushing 44 to allow the cutter wheel 10 to tilt about one or more axis that is substantially perpendicular to the longitudinal axis 26 and escape over flange 96. Wear patterns, or, more precisely, lack of wear patterns on the retainer pins 62 indicate that there is seldom any significant sustained axial forces directed away from the leg 12 of sufficient magnitude to push cutter wheel 10 off cylindrical bushing 44. Since the flange 96 and interfacing outside lateral surface 92 of cylindrical bushing 44 can withstand much more force than the seized fit and pin 62 retention of the cylindrical bushing 44 in cavity 54, it is unlikely that cylindrical bushing 44 will fail from whatever axial forces that would be encountered which are directed away from leg 12. Therefore, the most likely cause of failure is substantial wear or disintegration of cylindrical bushing 44, which would allow the cutter wheel 10 to escape from the spindle 40 as explained above.

Several features have been designed into the mounting structure of this invention to resist wear and likelihood of disintegration of cylindrical bushing 44, thus minimize likelihood of failure. First, the annular bearing surface 74 of top hat bushing 50 and the annular end bearing 84, 90 distribute heavy axial and lateral forces over additional surface areas, which minimizes concentration of forces, pressures, and stresses that might otherwise result in material failures. Second, the silver coating layer 80 on cylindrical bushing 44 and optionally on top hat bushing 50 provide a natural lubrication on interfacing harder metal surfaces 70, 72, 94 and optionally 76, 90, as described above. Third, the accurate machining of annular end bearing surface 76 in relation to annular bearing surface 74 in combination with the compressibility of the silver coating layer 80 and optionally silver coating layer 81 ensures that both annular inside bearing surface 72, and annular end bearing surface 76 bear the axial thrust forces $F_A$ and share the loading, as described above. Fourth, an improved seal 56 retaining structure, as will be described in more detail below, keeps abrasive debris away from the cylindrical bushing 44. Fifth, an improved lubrication system, which is also described in more detail below, provides lubrication to the interfaces between the cylindrical bushing 44 and surfaces 70, 72, 94 and to the interfaces between top hat bushing 50 and surfaces 76, 90 of cutter wheel 10.

Because of the typical distribution of lateral and axial force components $F_L$ and $F_A$ on the cutter wheel 10, it is usually prudent to place the cylindrical bushing 44 as close to the leg 12 as possible to minimize moment arms of force couples that tend to tilt or cock the cutter wheel 10 in relation to the spindle 40 and to maximize distance between the bearing surfaces 72, 76 to resist such force couples. However, it is also prudent to make the seal 56, which has to be positioned between the cylindrical bushing 44 and the end surface 100 of the cutter wheel 10 as large as possible. To meet both objectives of these criteria, the material left between the seal 56 and the end surface 100 has to be minimized, which leaves the seal 56 vulnerable to destruction when the end surface 100 wears.

As best seen in FIG. 3, the seal 56 is positioned in a specially shaped retainer groove 98 machined into the inside surface of cavity 54 between the cylindrical bushing 44 and the end surface 100 of cutter wheel 10. The retainer groove 98 positions the seal 56 on the peripheral surface of shoulder 58 to prevent debris that may lodge between end surface 100 of cutter wheel 10 and inside surface 42 of the leg 12 from migrating into the interface of surfaces 72, 76 or into the rest of race channel 49. The juxtaposed end surface 100 of cutter wheel 10 and inside surface 42 of leg 12 are not intended to be bearing surfaces, even though the surface 100 spins in relation to stationary surface 42 and even though they are positioned very close together to keep large debris out of that space. However, fine rock particles and debris can get between surfaces 42, 100 and cause substantial wear. Also, as other bushing and spindle interfaces or bushing and cutter wheel interfaces wear, the forces tend to push surface 100 closer and closer to surface 42 so that even if they do not actually touch, the fine debris between them causes more and more wear, which can be quite severe over the useable lifetime of the rock bit 14. Therefore, O-ring seals mounted anyplace in or near such surfaces 42, 100 are particularly vulnerable to such wear and eventual destruction. Of course, as soon as the seal 56 fails, nothing is left to keep debris away from bushing 44 where it will wear away and disintegrate bushing surfaces very quickly and cause the mounting structure to fail.

In the present invention, the side walls 102, 104 of seal retaining groove98 are slanted away from the end surface 100, which leaves more metal material structure between the O-ring seal 56 and the radially outermost extremity of the end surface 100 where most of the wear on surface 100 typically occurs. Therefore, the cutter wheel 10 can be used much longer before the surface 100 wears into the groove 98 and destroys the seal 56, which prolongs the useable life of the rock bit 14 and minimizes the chances of a mounting structure failing and disintegrating enough to allow the cutter wheel 10 to escape from the spindle 40 and be left at the bottom of the well hole 16 when the rest of the drill bit 14 is pulled out of the well hole 16.

The improved lubrication system of this invention includes a differential piston and cylinder assembly 110 for feeding grease gradually through ducts 112, 114, and 115 into the race channel 49 and extension bore 86 to lubricate bushings 44, 50. To appreciate how this lubrication system operates, it is necessary to understand that the well hole 16 is filled with a drilling fluid 116 (FIG. 1) that not only circulates to carry rock cuttings and debris out of the well hole 16, but also provides a fluid pressure sufficient to control high pressure oil, gas, or water reservoirs and keep them from blowing out. The lubrication system of this invention utilizes the fluid pressure of the drilling fluid to push grease to the bushings 44, 50. A cylinder 118 having a first inside surface 120 of larger diameter and a second inside surface 122 of smaller diameter is inserted into a reservoir hole 124 bored into the body of rock drill 14. An O-ring seal 125 around the cylinder 118 seals it in position. A piston 126 is provided with a first piston surface 128 at one end and a second piston surface 130 at its opposite end. The first piston surface 128 has a larger diameter, which is about the same (with tolerance for slidable fit) as the first inside surface 120 of cylinder 118. The second piston surface 130 has a smaller inside diameter, which is about the same (with tolerance for slidable fit) as the second inside surface 122 of cylinder 118. After filling the reservoir bore 124 with grease 140, the piston 126 is inserted into the cylinder 118 in a manner that positions the smaller second piston surface 130 inside the portion of the cylinder 118 that has the smaller second inside cylindrical surface 122 and that positions the larger first piston surface 128 inside the portion of the cylinder 118 that has the larger first inside cylindrical surface 120. O-ring seals 132, 134 seal the piston 126 to the respective first and second inside surfaces 120, 122 of the cylinder 118 to keep incompressible fluid, such as grease 140 or drilling fluid 116 (FIG. 1) out of the annular space 135 between the seals 132, 134, which would prevent the piston 126 from sliding in cylinder 118. A retainer ring 136 holds the cylinder 118 in the bore 124.

Fluids confined by surfaces exert pressures equally on all such confining surfaces at the same elevation or height. The drilling fluid 116 (FIG. 1) exerts pressure on all surfaces, including but not limited to such pressures indicated by arrows 142, 144, 146 in FIG. 3 at locations that are significant to the lubrication system of this invention. The small differences in elevation or height between arrows 142, 144, 146 is only inches, thus negligible, so fluid pressures 142, 144, 146 are substantially equal. The seal 56 does not withstand significant pressure differentials, and grease 140 is also a fluid, so the grease pressure indicated by arrow 148 in reservoir 124 as well as in all of the grease ducts 112, 114, 115 and in the spaces between bushings 44, 50 and other parts is also approximately equal to the drilling fluid pressure 142. The total force exerted by a fluid pressure on an object is equal to the fluid pressure multiplied by the surface area on which the pressure is applied on the object, i.e., Force=Pressure×Area. Therefore, because the first piston surface 128 has a larger area than the area of the second piston surface 130, the net force on the piston 126 is directed inwardly and tends to move the piston 126 into the reservoir 124, as indicated by arrow 150. Consequently, as the piston 126 moves inwardly as indicated by arrow 150, it pushes grease 140 from the reservoir 124 through the ducts 112, 114, 115 to the bushings 44, 50. A flattened area 152 where the duct 115 opens into the cylindrical surface 70 allows a uniform distribution of grease 140 to the bushing 44. As grease 140 is fed to bushings 44, 50, it migrates by mechanical action and localized pressure differentials between interfacing surfaces of spindle 40 and cutter wheel 10 and some of the grease 140 eventually escapes between the seal 56 and shoulder 58 to the space between end surface 100 of cutter wheel 10 and inner surface 42 of leg 12, where it also provides lubrication, and then dissipates into the drilling fluid. The resistance to grease 140 being pushed into the bushings 44, 50 is primarily due to the viscosity of the grease 140 and the very small, tight spaces into which the grease has to be pushed. Therefore, the first and second piston surfaces 128, 130 are preferably sized to have a difference in their respective areas sufficient to provide inward movement of the piston 126 at a very slow rate, which is sufficient to keep the bushings 44, 50 supplied with grease 140, but which is not so fast as to deplete the supply of grease in reservoir 124 before the rock bit 14 is pulled out of the well hole 16 for normal maintenance, replacement, or other reasons. Since fluid pressures increase as the well hole 16 gets deeper or as heavier drilling fluids 116 (FIG. 1) are used, the cylinder and piston assembly 110 can be pulled out of reservoir bore 124 and replaced with another cylinder and piston assembly sized to have either more or less differential between the areas of the piston surfaces 128, 130 as desired or required for a particular application. The plug 154 is shown to plug the end of duct 112 after it is drilled into reservoir bore 124.

The silver coating layer 80 on the bushing 44 presents particular challenges that have not been solved prior to this invention. Specifically, the silver coating layer 80 cannot be applied to the bushing 44 after the bushing 44 is split into two segments 46, 48, because the inside surface 82 of the bushing 44 is precisely machined to match the diameter of the bearing surface 70 of race channel 49 and to interface with the cylindrical bearing surface 70 of race channel 49 in the spindle 40. Any silver deposited on the split longitudinal edges 156, 158 of the bushing segments (see FIG. 2) would prevent the longitudinal edges 156, 158 from registering with each other and would therefore destroy that precise fit when the segments 46, 48 are assembled onto the spindle 40. At the same time, any flaking of the silver coating layer 80 would extend rapidly across the surface of the cylindrical bushing 44 when loading is applied, which would be detrimental to the performance of the cylindrical bushing 44. Therefore, any silver coating layer 80 that is applied prior to splitting the bushing 44 into segments 46, 48 cannot cause any flaking of the silver coating layer 80. Such splitting of silver coated bushings 44 without flaking was not thought to be possible prior to this invention.

Figure 4:
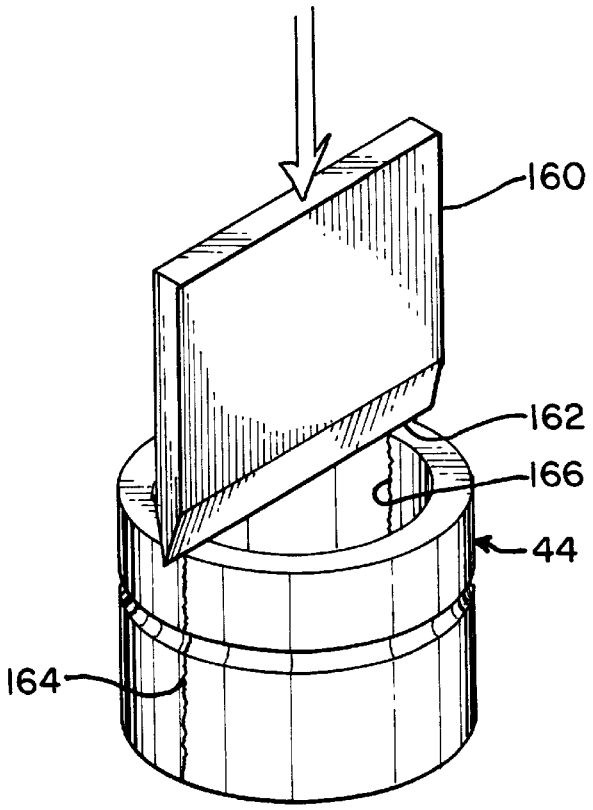
FIG. 4 is an isometric diagrammatic view of a chisel-like blade being used to split the bushing of this invention into two segments.

The silver flaking problem is solved by this invention with proper selection of materials and segmenting procedures. Referring to FIG. 4, the bushing 44 is machined from a stock of metal alloy known as D2, which is essentially a tool steel alloy that can be heat-treated to a Rockwell hardness in the range of about 58 to 61, which is brittle enough to split. The bushing 44 is coated with a layer of silver by any suitable coating process, such as electrochemical plating or vapor deposition, which are well-known to persons skilled in metal plating arts. The silver coating layer 80 is preferably about 0.001 to 0.004 inch thick. Then, the silver-coated bushing 44 is split as indicated at 164, 166 with a sharp edge 162 of a chisel-type tool that is made of a metal which is softer than the D2, but which is more impact resistant, such as S-7 tool steel.

Figure 5:
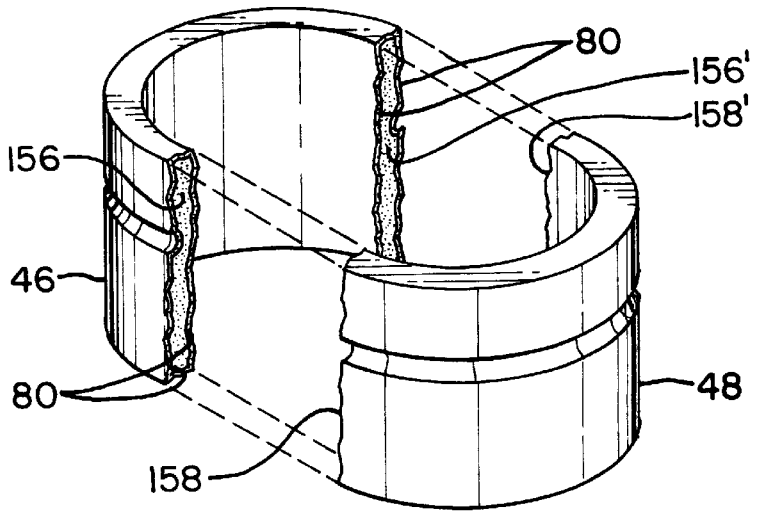
FIG. 5 is an isometric diagrammatic view of the segmented bushing illustrating the silver coating on the surfaces of the bushing according to this invention.

With this combination of materials, the silver-coated bushing 44 can be segmented into two segments 46, 48 without flaking the silver coating layer 80, as illustrated in FIG. 5. Such a split leaves the longitudinal edges 156, 156' of segment 46 and longitudinal edges 158, 158' of segment 48 clean and matched to their respective counterparts for registration together when they are mounted in the race channel 49 of spindle 40. It may be necessary to deburr the edges on the segments 46, 48, but such deburring can be done with a fine file or flexible abrasives without flaking the silver coating layer 80. An alternative, but far more expensive means to manufacture the bushing would be to employ wire EDM technology, with which small ran-out areas for the silver plating could be produced, similarly avoiding the flaking problem.

Figure 6:
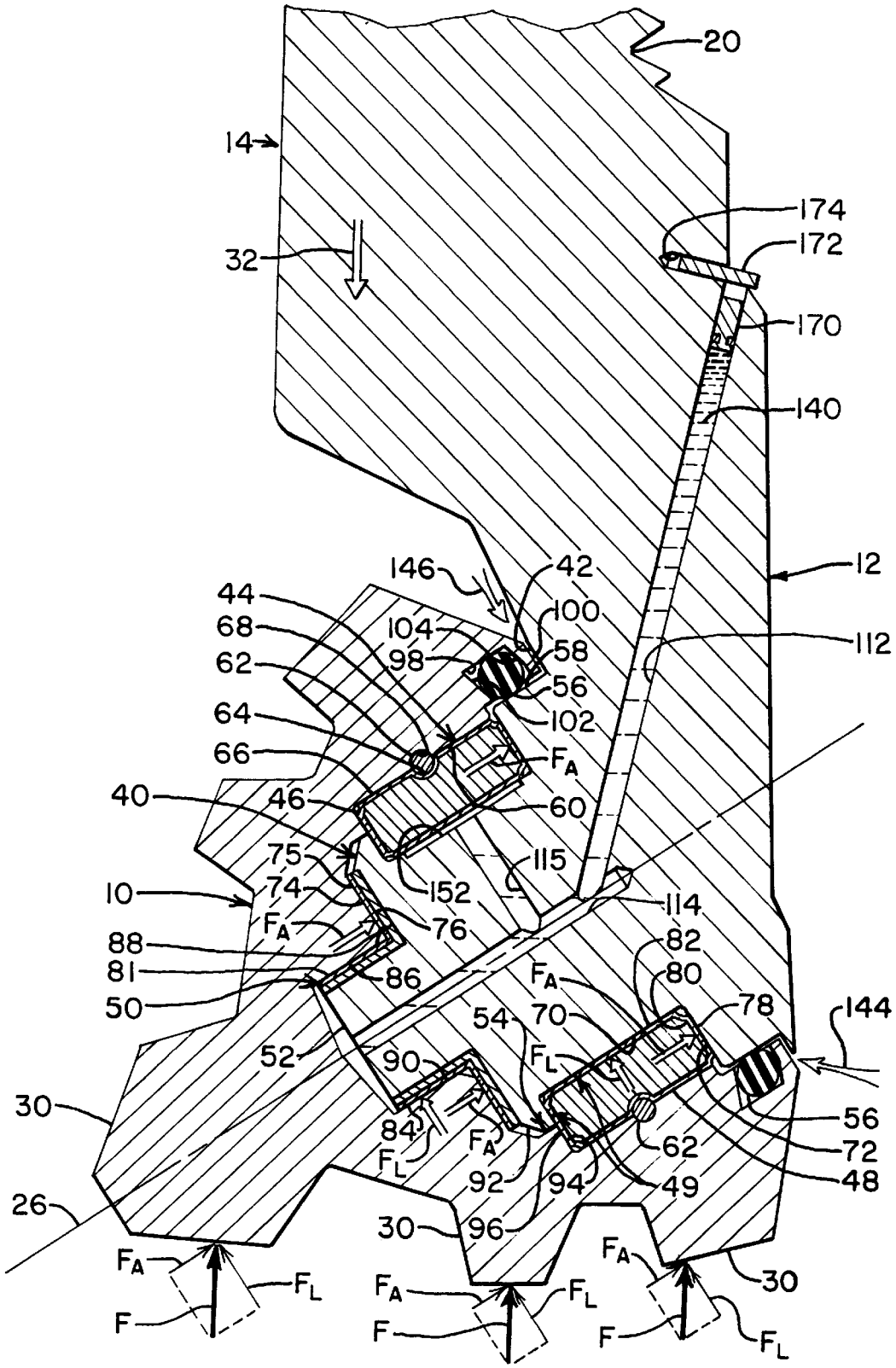
FIG. 6 is a cross-sectional view similar to FIG. 3, but showing an alternative lubrication system for smaller bits.

In smaller versions of the rock bit 14, the piston and cylinder assembly 110 may be too large for the smaller leg 12 of such a smaller rock bit. Therefore, as shown in FIG. 6, the lubrication system can comprise simply an elongated duct 112 extending through enough of the leg 12 a sufficient length to provide a reservoir of sufficient volume to hold enough grease 140 to lubricate the bushings until the rock bit is pulled out of the well for servicing. In this embodiment, a simple piston 170 is positioned slidably in the duct 112 to push the grease 140 to the bushings 44, 50. However, mechanical action of the cutter wheel 10 spinning on the bushings 44, 50 tends to draw grease from the duct 112 through the bushings and causes some of the grease to squeeze outwardly through the O-ring seal 56. The piston 170 is therefore primarily a follower, which is pushed by drilling fluid pressure to follow the grease through the duct 112 as the grease is drawn by the mechanical action described above into the bushings. A dowel pin 172 driven into a bore 174 in bit 14 can be used as a retainer to keep the piston 170 from sliding out of the duct 112.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. Cutter wheel and mounting apparatus for mounting a cutter wheel rotatably on a rock bit leg, comprising:

a spindle protruding axially from an inner surface of said rock bit leg, said spindle having a proximal end adjacent said inner surface of said leg, a distal end at a distance away from said inner surface of the leg, a cylindrical midsection between said proximal end and said distal end, an enlarged cylindrical shoulder between said midsection and said proximal end, an enlarged annular flange between said midsection and said distal end, a stub shaft extending axially from said flange to said distal end, an annular end surface extending radially outward from said stub shaft to said flange, wherein said cylindrical midsection, enlarged shoulder, and enlarged flange form an annular race channel between said enlarged cylindrical shoulder and said flange;

a cylindrical bushing with an outside diameter and an inside diameter positioned in said race channel in such a manner that said bushing is rotatable in said race channel in relation to said spindle; and said cutter wheel having an outer end surface and a cavity extending inwardly from said outer end surface to an inner end surface, said cavity forming a cylindrical inside surface between said outer end surface and said inner end surface, said cylindrical inside surface of said cavity having a midsection diameter that is the same as the outside diameter of the cylindrical bushing and an outer end section diameter that is large enough to allow the cutter wheel to slip over said enlarged shoulder of said spindle with an annular groove in said inside surface juxtaposed to said enlarged shoulder, said annular groove having a polyhedron-shaped cross section with opposed sidewalls that extend radially outward from said inside surface and that slant away from said outer surface, and further including an annular seal member positioned in said annular groove and in encircling, contacting relation with said enlarged shoulder, said cutter wheel being positioned in concentric relation to said spindle with said spindle and said cylindrical bushing being positioned concentrically in said cavity, said outer end surface being positioned radially outward from said shoulder in juxtaposition to said inner surface of said leg, said bushing being fixed in contacting, immoveable relation to said cylindrical inside surface of the cutter wheel, and said inner end surface of said cutter wheel being positioned in juxtaposition to said annular end surface of said spindle.

2. The cutter wheel mounting apparatus of claim 1, wherein said annular seal member is an O-ring elastomeric seal.

3. The cutter wheel and mounting apparatus of claim 1, wherein said cylindrical bushing comprises a first semicylindrical segment and a second semicylindrical segment, said first semicylindrical segment having a first longitudinal edge surface and a second longitudinal edge surface, said second semicylindrical segment having a third longitudinal edge surface and a fourth longitudinal edge surface, all surfaces of said first semicylindrical segment, except the first and second longitudinal edge surfaces, being coated with a layer comprising metal that is softer than said first semi-cylindrical segment, and all surfaces of said second semicylindrical segment, except the third and fourth longitudinal edge surfaces, being coated with a layer comprising metal that is softer than said second semi-cylindrical segment, and wherein said first and second longitudinal edge surfaces abut said third and fourth longitudinal edge surfaces, respectively.

4. The cutter wheel and mounting apparatus of claim 3, wherein said first semicylindrical segment has all surfaces except said first and second longitudinal edge surfaces coated with a layer of silver, and said second semicylindrical segment has all surfaces except said third and fourth longitudinal edge surfaces coated with a layer of silver.

5. The cutter wheel and mounting apparatus of claim 4, wherein said first semicylindrical segment and said second semicylindrical segment are pieces of a single cylindrical bushing that have been split apart from each other so that the first and second edges register with the third and fourth edges respectively.

6. The cutter wheel and mounting apparatus of claim 4, wherein said cavity in said cutter wheel is machined in such a manner that there is a clearance in a range of about 0.001 to 0.002 inch between the inner end surface of the cutter wheel and the annular end surface of the spindle when said cylindrical bushing contacts said enlarged shoulder.

7. The cutter wheel and mounting apparatus of claim 6, wherein said spindle includes a top hat bushing that has a cylindrical section positioned concentrically around said stub shaft and a flange section that forms said annular end surface.

8. The cutter wheel and mounting apparatus of claim 1, wherein said cavity in said cutter wheel is sized in such a manner that a said inner end surface of said cutter wheel contacts said annular end surface of said spindle when said cylindrical bushing is in contact with the enlarged shoulder.

9. The cutter wheel and mounting apparatus of claim 8, wherein said spindle includes a top hat bushing that has a cylindrical section positioned concentrically around said stub shaft and a flange section that forms said annular end surface.

10. The cutter wheel and mounting apparatus of claim 1, wherein said cavity in said cutter wheel is machined in such a manner that there is a clearance in a range of about 0.001 to 0.002 inch between the inner end surface of the cutter wheel and the annular end surface of the spindle when said cylindrical bushing contacts said enlarged shoulder.

11. The cutter wheel and mounting apparatus of claim 10, wherein said spindle includes a top hat bushing that has a cylindrical section positioned concentrically around said stub shaft and a flange section that forms said annular end surface.

12. The cutter wheel and mounting apparatus of claim 1, wherein said spindle includes a top hat bushing that has a cylindrical section positioned concentrically around said stub shaft and a flange section that forms said annular end surface.

13. Cutter wheel and mounting apparatus for mounting a cutter wheel rotatably on a rock bit leg, comprising:

a spindle protruding axially from an inner surface of said rock bit leg, said spindle having a proximal end adjacent said inner surface of said leg, a distal end at a distance away from said inner surface of the leg, a cylindrical midsection between said proximal end and said distal end, an enlarged cylindrical shoulder between said midsection and said proximal end, and an enlarged annular flange between said midsection and said distal end, wherein said cylindrical midsection, enlarged shoulder, and enlarged flange form an annular race channel between said enlarged cylindrical shoulder and said flange;

a cylindrical bushing with an outside diameter and an inside diameter positioned in said race channel in such a manner that said cylindrical bushing is rotatable in said race channel in relation to said spindle, said cylindrical bushing comprising a first semi-cylindrical segment and a second semi-cylindrical segment, said first semi-cylindrical segment having a first longitudinal edge surface and a second longitudinal edge surface, said second semi-cylindrical segment having a third longitudinal edge surface and a fourth longitudinal edge surface, and wherein said first and second longitudinal edge surfaces abutting said third and fourth longitudinal edge surfaces, respectively, and wherein said first semi-cylindrical segment has all surfaces except said first and second longitudinal edge surfaces coated with a layer of silver, and also wherein said second semi-cylindrical segment has all surfaces except said third and fourth longitudinal edge surfaces coated with a layer of silver; and said cutter wheel having an outer end surface and a cavity extending inwardly from said outer end surface to an inner end surface, said cavity forming a cylindrical inside surface between said outer end surface and said inner end surface, said cylindrical inside surface of said cavity having a midsection diameter that is the same as the outside diameter of the cylindrical bushing and an outer end section diameter that is large enough to allow the cutter wheel to slip over said enlarged shoulder of said spindle, said cutter wheel being positioned in concentric relation to said spindle, with said spindle and said cylindrical bushing being positioned concentrically in said cavity, said outer end surface being positioned radially outward from said shoulder in juxtaposition to said inner surface of said leg, and said cylindrical bushing being fixed in contacting, immoveable relation to said cylindrical inside surface of the cutter wheel.

14. The cutter wheel and mounting apparatus of claim 13, wherein said first semi-cylindrical segment and said second semi-cylindrical segment are pieces of a single cylindrical bushing that have been split apart from each other so that said first and second longitudinal edges register with said third and fourth longitudinal edges, respectively.

15. Cutter wheel and mounting apparatus for mounting a cutter wheel rotatably on a rock bit leg, comprising:

a spindle protruding axially from an inner surface of said rock bit leg, said spindle having a proximal end adjacent said inner surface of said leg, a distal end at a distance away from said inner surface of the leg, a cylindrical midsection between said proximal end and said distal end, an enlarged cylindrical shoulder between said midsection midsection and said proximal end, an enlarged annular flange between said midsection and said distal end, a stub shaft extending axially from said flange to said distal end, and an annular end bearing surface extending radially outward from said stub shaft to said flange, wherein said cylindrical midsection, enlarged shoulder, and enlarged flange form an annular race channel in said midsection of said spindle between said enlarged cylindrical shoulder and said flange, said annular race channel having a cylindrical bearing surface bounded by an annular inside bearing surface on said enlarged cylindrical shoulder, which annular inside bearing surface is larger in area than said annular end bearing surface;

a cylindrical bushing with an outside diameter and an inside diameter positioned in said race channel in such a manner that said bushing is rotatable in said race channel in relation to said spindle; and said cutter wheel having an outer end surface and a cavity extending inwardly from said outer end surface to an inner end bearing surface, said cavity forming a cylindrical inside surface between said outer end surface and said inner end bearing surface, said cylindrical inside surface of said cavity having a midsection diameter that is about the same as the outside diameter of the cylindrical bushing and an outer end section diameter that is large enough to allow the cutter wheel to slip over said enlarged shoulder of said spindle, with an annular groove in said inside surface juxtaposed to said enlarged shoulder, including an annular seal member positioned in said annular groove and in encircling, contacting relation with said enlarged shoulder, wherein said cutter wheel is positioned in concentric relation to said spindle, with said spindle and said cylindrical bushing being positioned concentrically in said cavity, said outer end surface being positioned radially outward from said shoulder in juxtaposition to said inner surface of said leg, said cylindrical bushing being fixed in contacting, immoveable relation to said cylindrical inside surface of the cutter wheel, said inner end bearing surface of said cutter wheel being positioned in juxtaposition to said annular end bearing surface of said spindle, and wherein said cavity in said cutter wheel is machined in such a manner that there is a clearance in a range of about 0.001 to 0.002 inch between the inner end bearing surface of the cutter wheel and the annular end bearing surface of the spindle when said cylindrical bushing contacts said annular inside bearing surface on said enlarged shoulder upon initial assembly, but, after initial wear-in of said cylindrical bushing and said juxtaposed annular inside bearing surface, said inner end bearing surface of the cutter wheel also contacts said annular end bearing surface of said spindle such that the annular inside bearing surface on said enlarged cylindrical shoulder bears a substantial portion of axial forces exerted by the cutter wheel onto the spindle, but is complimented by distribution of some of such axial forces onto said annular end bearing surface of the spindle.

16. The cutter wheel and mounting apparatus of claim 15, wherein the cylindrical bushing has a coating of metal that is more compressible than the cylindrical bushing to enhance said distribution of axial forces onto said annular end bearing surface of the spindle as well as to lubricate the cylindrical bushing against the annular inside bearing surface.

17. The cutter wheel and mounting apparatus of claim 16, wherein the cylindrical bushing comprises D2 metal alloy and said coating of metal comprises silver.

18. The cutter wheel and mounting apparatus of claim 15, wherein said spindle includes a top hat bushing that has a cylindrical section positioned concentrically around said stub shaft and a flange section that forms said annular end bearing surface.

19. Cutter wheel and mounting apparatus for mounting a cutter wheel rotatably on a rock bit leg comprising:

a spindle with a cylindrical surface protruding from a surface of the rock bit leg, said cutter wheel having a cavity forming a cylindrical inside surface that encircles the cylindrical surface of the spindle, said cutter wheel also having an annular groove in said inside surface juxtaposed to the cylindrical surface of the spindle, wherein said annular groove has a polyhedron-shaped cross section with opposed sidewalls that extend radially outward from the cylindrical inside surface of the cutter wheel and slant away from the surface of the rock bit leg; and an annular seal member positioned in said annular grove in encircling, contacting relation to the cylindrical surface of the spindle.

20. Cutter wheel and mounting apparatus for mounting a cutter wheel rotatably on a rock bit leg, comprising:

a spindle protruding from the rock bit leg into a cavity in said cutter wheel; and a cylindrical bushing made of a first metal and having bushing surfaces that bear on bearing surfaces on said spindle and in said cutter wheel, said cylindrical bushing comprising a first semicylindrical segment and a second semicylindrical segment, said first semicylindrical segment having a first longitudinal edge surface and a second longitudinal edge surface, said second semicylindrical segment having a third longitudinal edge surface and a fourth longitudinal edge surface, said bushing surfaces, but not said first, second, third, and fourth longitudinal edge surfaces, being coated with a layer comprising a second metal that is softer than said first metal, and wherein said first and second longitudinal edge surfaces abut and register, respectively, with said third and fourth longitudinal edge surfaces.

21. Cutter wheel and mounting apparatus for mounting a cutter wheel rotatably on a rock bit leg, comprising:

a spindle extending from the rock bit leg and having an end bearing surface and an annular inside bearing surface, and said cutter wheel having (i) a cavity into which said spindle extends, (ii) an inner end bearing surface juxtaposed axially to said end bearing surface of the spindle, and (iii) a cylindrical bushing juxtaposed axially to said annular inside bearing surface, wherein said cavity in said cutter wheel is machined in such a manner that there is a clearance in a range of about 0.001 to 0.002 inch between the inner end bearing surface of the cutter wheel and the end bearing surface of the spindle when the cylindrical bushing contacts the annular inside bearing surface of the spindle.

* * * * *